US011885537B2

(12) United States Patent
Winandy et al.

(10) Patent No.: US 11,885,537 B2
(45) Date of Patent: Jan. 30, 2024

(54) CONTROL OF REFRIGERANT INJECTION INTO A COMPRESSOR IN AN ECONOMIZED REFRIGERATION CYCLE

(71) Applicant: Emerson Climate Technologies GmbH, Berlin (DE)

(72) Inventors: Eric Winandy, Esneux (BE); Remi Dickes, Aachen (DE); Paolo Chiaramonte, Belluno (IT); Luca Mazzorana, Belluno (IT)

(73) Assignee: Copeland Europe GmbH, Berlin (DE)

( * ) Notice: Subject to any disclaimer, the term of this patent is extended or adjusted under 35 U.S.C. 154(b) by 0 days.

(21) Appl. No.: 18/162,427

(22) Filed: Jan. 31, 2023

(65) Prior Publication Data

US 2023/0175746 A1 Jun. 8, 2023

Related U.S. Application Data

(63) Continuation of application No. 17/238,145, filed on Apr. 22, 2021, now abandoned.

(30) Foreign Application Priority Data

Apr. 24, 2020 (EP) ..... 20171292

(51) Int. Cl.
*F25B 41/31* (2021.01)
*F25B 31/00* (2006.01)
(Continued)

(52) U.S. Cl.
CPC ..... *F25B 31/008* (2013.01); *F25B 41/31* (2021.01); *F25B 43/02* (2013.01); *F25B 49/02* (2013.01);
(Continued)

(58) Field of Classification Search
CPC ..... F25B 49/02; F25B 43/02; F25B 41/31; F25B 31/008; F25B 2700/191;
(Continued)

(56) References Cited

U.S. PATENT DOCUMENTS

2003/0010046 A1 1/2003 Freund et al.
2014/0151015 A1* 6/2014 Sun ..... F25B 41/00 62/190
(Continued)

FOREIGN PATENT DOCUMENTS

WO WO-2014120332 A1 * 8/2014 ..... B60H 1/3228

OTHER PUBLICATIONS

Reason, Multi-compartment transport refrigeration system with economizer, 2014, Full Documetnt (Year: 2014).*
(Continued)

*Primary Examiner* — Nael N Babaa
(74) *Attorney, Agent, or Firm* — Harness, Dickey & Pierce, P.L.C.

(57) ABSTRACT

A method of controlling injection into a compressor in a refrigeration cycle is described. A refrigeration cycle may comprise at least an economizer heat exchanger, a heat rejection heat exchanger, a first expansion device, and a compressor. A discharge port of the compressor is connected to the heat rejection heat exchanger via a discharge line and an injection port of the compressor is connected to the means for compressing. The economizer heat exchanger comprises a first path having an input connected to the heat rejection heat exchanger and an output connected to the first expansion device, and a second path having an input connected to the heat rejection heat exchanger via an economizer valve and an output connected to the injection port of the com-
(Continued)

pressor via an injection line. The economizer valve is regulated based on a superheat level of the refrigerant in the economizer heat exchanger.

13 Claims, 10 Drawing Sheets

(51) Int. Cl.
*F25B 43/02* (2006.01)
*F25B 49/02* (2006.01)

(52) U.S. Cl.
CPC ... *F25B 2400/13* (2013.01); *F25B 2600/2501* (2013.01); *F25B 2600/2513* (2013.01); *F25B 2700/191* (2013.01)

(58) Field of Classification Search
CPC ..... F25B 2600/2513; F25B 2600/2501; F25B 2400/13
See application file for complete search history.

(56) References Cited

U.S. PATENT DOCUMENTS

2015/0033780 A1 2/2015 Hatomura et al.
2019/0078818 A1 3/2019 Khaled et al.

OTHER PUBLICATIONS

Extended European Search Report regarding Application No. 20171292.4 dated Oct. 1, 2020.

* cited by examiner

CONTROL OF REFRIGERANT INJECTION INTO A COMPRESSOR IN AN ECONOMIZED REFRIGERATION CYCLE

CROSS-REFERENCE TO RELATED APPLICATIONS

This application is a continuation of U.S. patent application Ser. No. 17/238,145 filed on Apr. 22, 2021, which claims priority to European Patent Application No. 20171292.4 filed on Apr. 24, 2020. The entire disclosures of each applications are incorporated herein by reference.

FIELD

The present patent application relates to a method for controlling refrigerant injection into a compressor in a refrigeration cycle, wherein the refrigeration cycle comprises an injection compressor and an economizer.

BACKGROUND

Refrigeration systems having a refrigeration cycle are well known in the art. In a common refrigeration cycle, a refrigerant is circulated through a refrigeration system, in which it undergoes changes in thermodynamic properties in different parts of the refrigeration system. The refrigerant is a fluid, i.e. a liquid or a vapour or a gas, respectively. Examples of refrigerants may be artificial refrigerants like fluorocarbons. However, in recent applications, the use of carbon dioxide, $CO_2$, which is a non-artificial refrigerant, has become more and more important, because it is non-hazardous to the environment. The changes in thermodynamic properties of the refrigerant may, for example, include changes in temperature, pressure, volume, or enthalpy, wherein sometimes the changes in one property may also affect at least one other property, or wherein in some cases at least one property may stay constant while another property is changing. The changes in thermodynamic properties may go along with phase transitions of at least a portion of the refrigerant, for example from liquid to vapour and vice versa.

The refrigerant is used in a refrigeration system for transporting heat in a refrigeration cycle. Thereby, heat is usually transported from one point in the refrigeration cycle to another point in the refrigeration cycle by ease of the refrigerant. For example, these points in the refrigeration cycle may be represented by heat exchangers. In a first heat exchanger, the refrigerant may accept heat from a source. The source may be, for example, the air of a room the temperature of which shall be controlled. After being transported to a second heat exchanger, the refrigerant may reject heat in the second heat exchanger, for example, by transferring heat to exhaust air.

Nowadays, refrigeration systems are of particular importance for controlling temperature or climate conditions. A particular type of a refrigeration system is a compression refrigeration system, which sometimes is referred to as vapour compression refrigeration system (VCRS).

As used herein, a refrigeration cycle comprises at least a compressor for compressing the refrigerant. Compressing the refrigerant may drive the cycle. Further, such a refrigeration cycle commonly comprises a heat exchanger, in which heat may be extracted from the compressed refrigerant. The extraction of heat from the compressed refrigerant is sometimes referred to as heat rejection, because heat is rejected from the refrigeration system. Accordingly, this heat exchanger often is referred to as heat rejection heat exchanger. Further, such a refrigeration cycle commonly comprises an expansion device, in which the pressure and thereby the temperature of the refrigerant are reduced. The expansion device may be, for example, a valve, in particular an expansion valve, or a metering device. In addition, such a refrigeration cycle commonly comprises another heat exchanger, which may be used for accepting heat from a source. The other heat exchanger is often referred to as heat accepting heat exchanger. The heat accepting heat exchanger is in fluid communication with the compressor, so that the refrigerant is guided to the compressor in order to close the cycle.

In some refrigeration cycles, a compressor is used for driving the refrigeration cycle. Such a compressor commonly comprises a suction port and a discharge port, as well as a means for compressing. The suction port is configured for receiving refrigerant from the refrigeration cycle. For example, the refrigerant may be received from the heat accepting heat exchanger. The suction port is in fluid communication with the compression chamber for at least a first time instance for providing the refrigerant to the means for compressing. In the means for compressing, the refrigerant will be compressed to a desired pressure. The compression in general increases the pressure of the refrigerant. This may go along with an increase in temperature of the refrigerant. In case the compressor may be a scroll compressor, the means for compressing may be formed by the scroll set of the scroll compressor.

The means for compressing is in fluid communication with the discharge port of the compressor for at least a second time instance for providing the compressed refrigerant to the discharge port. At the discharge port, the compressed refrigerant may be discharged from the compressor at a desired discharge pressure or desired discharge temperature.

In some refrigeration cycles, the compressor may be an injection compressor. Additionally to the aforementioned features of a compressor, an injection compressor comprises an injection port. The injection port is in fluid communication with a source for providing refrigerant. A source may be, for example, an economizer. Further, the injection port is in fluid communication with the means for compressing of the compressor for at least a third time instance. In case that the injection port is in fluid communication with the means for compressing, refrigerant is provided from the source to the means for compressing of the compressor. The refrigerant, which is provided from the source to the means for compressing, may be referred to as additional refrigerant, injected refrigerant, or fresh refrigerant. In most applications, the injected refrigerant is in a vapour state. However, in particular circumstances, it may be beneficial to inject liquid refrigerant additionally to the vapour refrigerant—for example, in a case, in which the temperature of the refrigerant in the compressor needs to be reduced.

In general, the efficiency of the system, which is represented by a so-called coefficient of performance (COP), depends on the temperature or pressure difference between the refrigerant in the heat rejection heat exchanger and the temperature or pressure of the refrigerant in the heat accepting heat exchanger. However, injection conditions, like pressure and temperature, have a direct influence on the efficiency of the system. Therefore, controlling the refrigerant system based only on the temperature of the refrigerant in the heat rejection heat exchanger may result in inefficient operation or in fluctuations of the cooling, which is provided by the refrigeration system. Hence, there is a need in the art for improving the efficiency of refrigeration systems.

This need is overcome by the method for controlling injection into a compressor of a refrigeration cycle according to the presented invention.

In general, the presented invention relates to a method for controlling injection into a compressor of a refrigeration cycle based on the superheat level of the refrigerant in the economizer. The method may comprise different operation modes. In some embodiments of the current invention, one of these operation modes may establish a default operation mode for the method according to the current invention, while other operation modes may be used under particular system conditions. In this case, the method according to the current invention provides a method of switching between suitable operation modes. Alternatively, in other embodiments of the current invention, the method does not establish a default mode, but may select a suitable operation mode from a number of equitable operation modes based on determined system parameters.

A method of controlling injection into a compressor in a refrigeration cycle according to the invention is performed in a refrigeration cycle, which comprises at least an economizer, a heat rejection heat exchanger, a first expansion device, and a compressor configured for compressing the refrigerant. The compressor comprises a means for compressing, a suction port, a discharge port, and an injection port. The heat rejection heat exchanger may be disposed downstream of the discharge port of the compressor. The connection between the discharge port and the heat rejection heat exchanger may be referred to as discharge line. The first expansion device may be disposed downstream of the heat rejection heat exchanger and upstream of the suction port of the compressor. Further, the refrigeration cycle may comprise a heat accepting heat exchanger, which is disposed downstream of the first expansion device and upstream of the suction port of the compressor.

The injection port is connected to the means for compressing for at least a particular time instance. The means for compressing is configured for receiving a refrigerant from the suction port and/or the injection port of the compressor. Further, the means for compressing compresses the refrigerant. Further, the means for compressing may be configured for providing the compressed refrigerant to the discharge port of the compressor.

In a preferred embodiment, the compressor may be a scroll compressor and the means for compressing may be formed by a scroll set of the scroll compressor.

The economizer comprises an economizer heat exchanger, which comprises a first path and a second path, for exchanging heat between refrigerant in the first path and refrigerant in the second path. The first path has an input, which is connected to the heat rejection heat exchanger, and an output, which is connected to the first expansion device. The second path has an input, which is connected to the heat rejection heat exchanger via an economizer valve, and an output, which is connected to the injection port of the compressor via an injection line. Preferably, the first path and the second path of the economizer have counterwise flow directions. However, it may also be possible that the first path and the second path have other flow relative flow directions. For example, it may be possible that the first path and the second path are oriented in co-current flow directions or in cross-flow directions, where the orientation of the flow in the first path is perpendicular to the orientation of the flow in the second path. Furthermore, any combination of the mentioned flow types is possible. Since the present invention deals with the control of the refrigerant in the refrigerant cycle of the refrigerant system, the term connected is used throughout the application to describe a connection, which enables a fluid communication via this connection. In other words, the connection enables the exchange of refrigerant between the connected entities.

SUMMARY

According to the present invention, the method comprises regulating the economizer valve by using a first operation mode, which is based on a superheat level of the refrigerant in the economizer heat exchanger. The method may also comprise determining the superheat level of the refrigerant in the economizer heat exchanger. The superheat level may, for example, be determined at the output of the second path of the heat rejection heat exchanger.

The regulating may comprise calculating an opening degree of the economizer valve based on the superheat level of the refrigerant in the economizer heat exchanger and setting the opening degree to the calculated value. Throughout this application, anytime it is mentioned that an opening degree is calculated, this may also include setting the opening degree to the calculated value.

The first operation mode may be referred to as superheat control mode. This operation mode is based on the finding that a maximum of the refrigeration cycle efficiency is reached with a minimum superheat at the economizer. Superheat may be measured in temperature increase compared to the boiling point. For example, a superheat value of 5 Kelvin would refer to a temperature increase of 5 Kelvin compared to the saturation point. The saturation point may also be referred to as boiling point. The desired superheat value depends on the refrigerant, which is used. In typical $CO_2$ refrigeration cycles, a value of 5 Kelvin is the target for the superheat in the economizer, since lower values may cause instabilities or may cause the injection of droplets into the compressor, which would decrease the cycle efficiency. Other preferred refrigerants, which have the same target superheat value of 5 Kelvin are R717 (ammonia), R290 (propane), and R32.

The superheat level (SH) may be calculated based on the temperature measured at the output of the second path of the economizer and the saturation temperature measured downstream of the economizer valve. Said saturation temperature, which may also be referred to as boiling temperature, may be measured directly or indirectly. An example of a direct temperature measurement is to measure the temperature between the economizer valve and the inlet port of the second path of the economizer. An example of an indirect temperature measurement is to measure the pressure at said location and determine the temperature from the pressure. Using said temperature values, the superheat level may be calculated by $SH=T_{out}-T_{sat}$, with $T_{out}$ being the temperature measured at the outlet port of the second path of the economizer and $T_{sat}$ being the saturation temperature.

The first operation mode may be referred to as superheat control mode and may comprise setting an opening degree of the economizer valve to a value calculated by using the first operation mode in order to keep the superheat level of the refrigerant at the output of the second path of the economizer heat exchanger at a first predetermined setpoint. The predetermined setpoint may be set by a manufacturer or an operator of the respective refrigeration system. In some embodiments, the calculated value for the opening degree may be a pre-calculated value. Further, this pre-calculated value may be updated by a feedback controller, for example a PID controller.

In a preferred embodiment, different operation modes may be used for controlling the economizer valve. For example, the first operation mode, which may be referred to as superheat control mode, may be a default operation mode of the control of the injection control. At least two additional operation modes may be provided. Among these two additional operation modes may be a second operation mode, which may be referred to as discharge line temperature (DLT) control mode, and a third operation mode, which may be referred to as economizer heat exchanger pressure (EHXP) control mode or injection pressure control mode.

According to at least some embodiments of the present invention, it may be possible to determine system parameters and to switch from the first operation mode to either one of the second operation mode and the third operation mode based on the determined system parameters. The person skilled in the art will appreciate that it is also possible to switch from any of the second operation mode and the third operation back to the first operation mode based on the determined system parameters. Also, it may be possible to switch from the second operation mode directly to the third operation mode and vice versa. Accordingly, the determination of the system parameters may allow any switching between the operation modes. The system parameters may include any temperature or pressure of the refrigerant in the refrigeration cycle, as well as the superheat level. Preferably, the superheat level of the refrigerant at the output of the second path of the economizer heat exchanger, the pressure of the refrigerant in the injection line, and the temperature of the refrigerant, which is discharged from the compressor, are used. In most applications, the pressure of the refrigerant in the second path of the economizer and the pressure of the refrigerant in the injection line are essentially the same. For the purpose of this application, these system parameters may be used interchangeably.

The second operation mode may be referred to as discharge line temperature control mode. The aim of the second operation mode is to prevent the temperature of the refrigerant in the compressor from exceeding a threshold, which would be harmful for the refrigeration system. This may be performed by injecting liquid refrigerant additionally to the vapour refrigerant. Since liquid injection may cause dysfunction of the compressor, it is desired to keep liquid injection as low as possible.

In a preferred embodiment, the method may further comprise the steps of determining a pressure of the refrigerant in the injection line and determining a temperature of the refrigerant in the discharge line. The pressure of the refrigerant in the injection line and the temperature of the refrigerant in the discharge line may be examples of system parameters, the determination of which may enable a switching between operation modes.

Based on the determined pressure and the determined temperature, it may be determined whether to proceed with regulating the economizer valve by using the first operation mode or whether to perform one of regulating the economizer valve by using the second operation mode or regulating the economizer by using the third operation mode. Thereby, the regulating the economizer valve by using the second operation mode is based on the temperature of the refrigerant in the discharge line and the regulating the economizer valve by using the third operation mode is based on the pressure of the refrigerant in the injection line.

The second operation mode, which may be referred to as DLT control mode, may comprise regulating the economizer valve in order to keep the temperature of the refrigerant in the discharge line below a second predetermined setpoint. The second predetermined setpoint may be set by a manufacturer or an operator of the respective refrigeration system. Such a predetermined setpoint may be updated by a feedback controller, for example a PID controller.

The third operation mode may be referred to as injection pressure control mode. This mode can be used in case that the discharge temperature of the refrigerant at the compressor is under control, but the pressure inside the compressor is rising. Accordingly, the economizer valve needs to be closed to a higher degree than would be desired reaching a superheat target. This is necessary to restrict the injection of refrigerant into the compressor and thereby reduce the pressure inside the compressor.

The third operation mode, which may be referred to as EHXP operation mode, may comprise regulating the economizer valve in order to keep the pressure of the refrigerant in the injection line under a third predetermined setpoint. The third predetermined setpoint may be set by a manufacturer or an operator of the respective refrigeration system. Such a predetermined setpoint may be updated by a feedback controller, for example a PID controller.

In some preferred embodiments, the above-mentioned regulating may be performed based on a combination of two or more of the first, second, and third operation modes.

In a preferred embodiment, the regulating may comprise closing the economizer valve, if the pressure of the refrigerant in the injection line is determined to be below a first threshold. The first threshold may be referred to as a minimum injection pressure at the economizer for injection into the compressor. The minimum injection pressure may depend on the operating conditions of the compressor. Also, the minimum injection pressure may correspond to setpoint, which is predetermined by a manufacturer or an operator of the refrigeration system.

If the pressure of the refrigerant in the injection line is below the minimum injection pressure, it is necessary to close the economizer valve and thereby prevent refrigerant from being injected into the compressor. Otherwise, the pressure in the injection line may be lower than the pressure in the means for compression at the point, where the refrigerant should be injected into the means for compressing. Accordingly, this may lead to undesired reverse flow of refrigerant form the compressor through the injection line.

Further, the regulating may comprise, if the pressure of the refrigerant in the injection line is determined to be above the first threshold and below a second threshold, setting an opening degree of the economizer valve to a value calculated by using the first operation mode, the second operation mode, or a combination of both. The second threshold may be referred to as a maximum injection pressure at the economizer for the first operation mode and the second operation mode.

Further, the regulating may comprise, if the pressure of the refrigerant in the injection line is determined to be above the second threshold and below a third threshold, setting the opening degree of the economizer valve to a value calculated by using a combination of at least the first operation mode and the third operation mode.

Further, the regulating may comprise, if the pressure of the refrigerant in the injection line is determined to be above the third threshold and below a fourth threshold, setting the opening degree of the economizer valve to a value calculated by using the third operation mode and if the pressure of the refrigerant in the injection line is determined to be above the fourth threshold, closing the economizer valve and stopping the operation of the compressor. The fourth threshold may be referred to as a maximum injection pressure. Since too high injection pressures may harm the operation of the compressor or the compressor itself, the fourth threshold may correspond to a safety condition, which prevents the pressure inside the compressor from rising beyond the fourth threshold.

In a further preferred embodiment, if the determined pressure of the refrigerant in the discharge line is above the first threshold but below the second threshold, the setting the economizer valve to a value calculated by using the first operation mode or the second operation mode may comprise, if the temperature of the refrigerant in the discharge line is below a fifth threshold, setting the opening degree of the economizer valve to a value calculated from the superheat level of the refrigerant in the economizer heat exchanger. The fifth threshold may be referred to as discharge temperature threshold for enabling superheat and temperature control. Below the fifth threshold, only the superheat value of the refrigerant is used for calculating the opening degree of the economizer valve in case that the pressure of the refrigerant in the injection line is below the second threshold. The aim of this operation is to optimize the superheat value by reaching the superheat target value.

Further, the setting the opening degree of the economizer valve may comprise, if the temperature of the refrigerant in the discharge line is above the fifth threshold and below a sixth threshold, setting the opening degree of the economizer valve to a value calculated from the superheat level of the refrigerant in the economizer heat exchanger and the determined temperature of the refrigerant, which is discharged from the compressor. The sixth threshold may be referred to alarm discharge line temperature threshold. The fifth threshold and the sixth threshold define a transition area, in which a combination of the first operation mode and the second operation mode is performed.

Further, the setting the opening degree of the economizer valve may comprise, if the temperature of the refrigerant in the discharge line is above the sixth threshold and below a seventh threshold, setting the opening degree of the economizer valve to a value calculated from the determined temperature of the refrigerant, which is discharged from the compressor. Also, the setting the opening degree of the economizer valve may comprise, if the temperature of the refrigerant in the discharge line is determined to be above the seventh threshold, closing the economizer valve and stopping the operation of the compressor. The seventh threshold may be referred to as maximum discharge line temperature threshold. This threshold may define a temperature point above which refrigerant injection into the compressor would be harmful for the compressor. Hence, if the discharge line temperature exceeds the seventh threshold, the economizer valve is closed and the injection is stopped. Preferably, the operation of the compressor is also stopped.

In a further preferred embodiment, if the determined pressure of the refrigerant in the discharge line is above the second threshold but below the third threshold, the setting the opening degree of the economizer valve to a value calculated by using the third operation may comprise, if the determined temperature of the refrigerant in the discharge line is below a eighth threshold, setting the opening degree of the economizer valve to a value calculated from the determined pressure of the refrigerant in the injection line and the superheat value. Thereby, a combination of the first and the third operation modes is performed.

Further, the setting the opening degree of the economizer valve may comprise, if the determined temperature of the refrigerant in the discharge line is above the eighth threshold and below a ninth threshold, setting the opening degree of the economizer valve to a value calculated from the determined pressure of the refrigerant in the injection line, the determined temperature of the refrigerant, which is discharged from the compressor, and the superheat value. Thereby, a combination of all three operation modes may be performed.

Further, the setting the opening degree of the economizer valve may comprise, if the determined temperature of the refrigerant in the discharge line is above the ninth threshold, closing the economizer valve and stopping the operation of the compressor.

In at least some embodiments, the eighth threshold may be equal to the fifth threshold. Also, the ninth threshold may be equal to the seventh threshold.

In another preferred embodiment, if the determined pressure of the refrigerant in the discharge line is above the third threshold but below the fourth threshold, the setting the opening degree of the economizer to a value calculated by using calculated by using at least the third operation mode may comprise, if the determined temperature of the refrigerant in the discharge line is below a tenth threshold, setting the opening degree of the economizer valve to a value calculated from the determined pressure of the refrigerant at economizer heat exchanger.

Further, the setting the opening degree of the economizer valve may comprise, if the determined temperature of the refrigerant in the discharge line is above the tenth threshold and below an eleventh threshold, setting the opening degree of the economizer valve to a value calculated from the determined pressure of the refrigerant at economizer heat exchanger, the determined temperature of the refrigerant in the discharge line, and the superheat value.

Also, the setting the opening degree of the economizer valve may comprise, if the determined temperature of the refrigerant in the discharge line is above the eleventh threshold, closing the economizer valve and stopping operation of the compressor.

In at least some embodiments, the tenth threshold may be equal to the fifth threshold. Also, the eleventh threshold may be equal to the seventh threshold.

In an alternative embodiment of the present invention, the method for controlling injection into a compressor may not use a default operation mode, but may instead determine system parameters and determine a suitable control operation mode based on the determined system parameters.

According to the current invention, an alternative method of controlling injection into a compressor in a refrigeration cycle according to the invention is performed in a refrigeration cycle, which comprises at least an economizer, a heat rejection heat exchanger, a first expansion device, and a compressor configured for compressing the refrigerant. The compressor comprises a means for compressing, a suction port, a discharge port, and an injection port. The heat rejection heat exchanger may be disposed downstream of the discharge port of the compressor. The connection between the discharge port and the heat rejection heat exchanger may be referred to as discharge line. The first expansion device may be disposed downstream of the heat rejection heat exchanger and upstream of the suction port of the compressor. Further, the refrigeration cycle may comprise a heat accepting heat exchanger, which is disposed downstream of the first expansion device and upstream of the suction port of the compressor.

The injection port is connected to the means for compressing for at least a particular time instance. The means for compressing is configured for receiving a refrigerant from the suction port and/or the injection port of the compressor. Further, the means for compressing compresses the refrigerant. Further, the means for compressing may be configured for providing the compressed refrigerant to the discharge port of the compressor.

In a preferred embodiment, the compressor may be a scroll compressor and the means for compressing may be formed by a scroll set of the scroll compressor.

The economizer comprises an economizer heat exchanger, which comprises a first path and a second path, for exchanging heat between refrigerant in the first path and refrigerant in the second path. The first path has an input, which is connected to the heat rejection heat exchanger, and an output, which is connected to the first expansion device. The second path has an input, which is connected to the heat rejection heat exchanger via an economizer valve, and an output, which is connected to the injection port of the compressor via an injection line. Since the present invention deals with the control of the refrigerant in the refrigerant cycle of the refrigerant system, the term connected is used throughout the application to describe a connection, which enables a fluid communication via this connection. In other words, the connection enables the exchange of refrigerant between the connected entities.

According to the present invention, the method comprises determining a pressure of the refrigerant in the injection line and determining a temperature of the refrigerant discharged from the discharge port of the compressor. The determining may be performed by one or more sensors.

Further, the method comprises selecting, based on the determined pressure and the determined temperature, one of a first operation mode for regulating the economizer valve based on a superheat level of the refrigerant in the economizer heat exchanger, a second operation mode for regulating the economizer valve based on the temperature of the refrigerant in the discharge line, and a third operation mode for calculating the economizer valve based on the pressure of the refrigerant in the injection line. Also, the method comprises regulating the economizer valve by using the selected operation mode.

The thresholds, which are described throughout this application, may be independent from the operating conditions of the refrigeration system in at least some embodiments. However, in other embodiments, at least one of the thresholds may be dependent on the operating conditions of the refrigeration system. For example, the third threshold may depend on at least one of the pressure of the refrigerant in the heat rejection heat exchanger, the pressure of the refrigerant in the heat accepting heat exchanger, or the ambient temperature. In this case, the controller, which performs the method according to the invention may comprise a logic for adaptively adjusting the third threshold based on the operating conditions of the refrigeration system. Since the third threshold may be the maximum injection pressure, a dependency of the third threshold on the operating conditions of the refrigeration system may improve the flexibility of the control, may result in a higher COP and increased reliability of the compressor, and may also protect the compressor from failure.

The following description and the annexed drawings set forth in detail certain illustrative aspects of the systems described above. These aspects are indicative, however, of but a few of the various ways in which the principles of various embodiments can be employed and the described embodiments are intended to include all such aspects and their equivalent.

DRAWINGS

In the drawings, like reference characters generally refer to the same parts throughout the different drawings. The drawings are not necessarily to scale, emphasis instead generally being placed upon illustrating the principles of the invention.

In the following description, various embodiments of the invention are described with reference to the following drawings, in which.

Figure 4A:
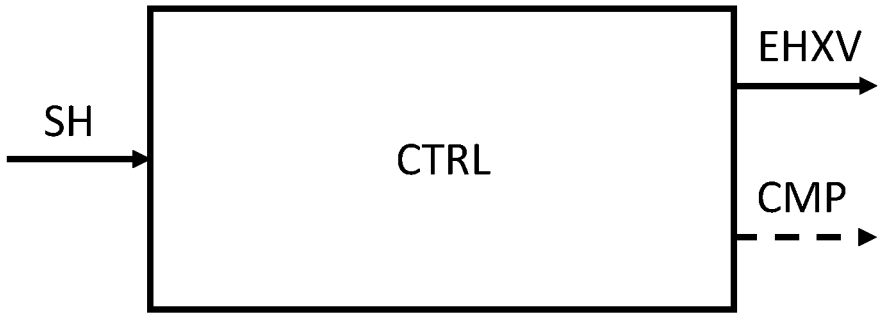
Figure 4B:
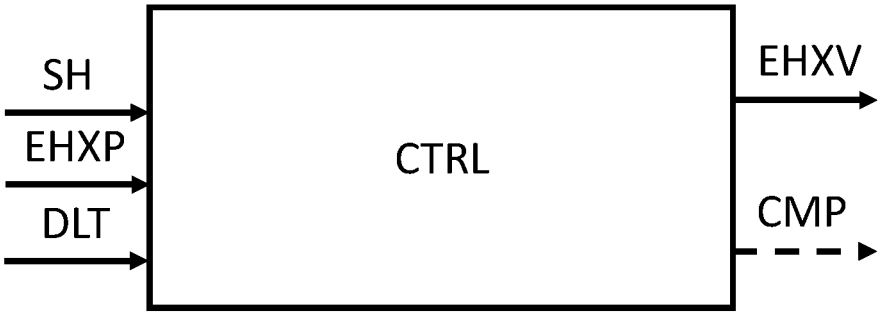
Figure 5:
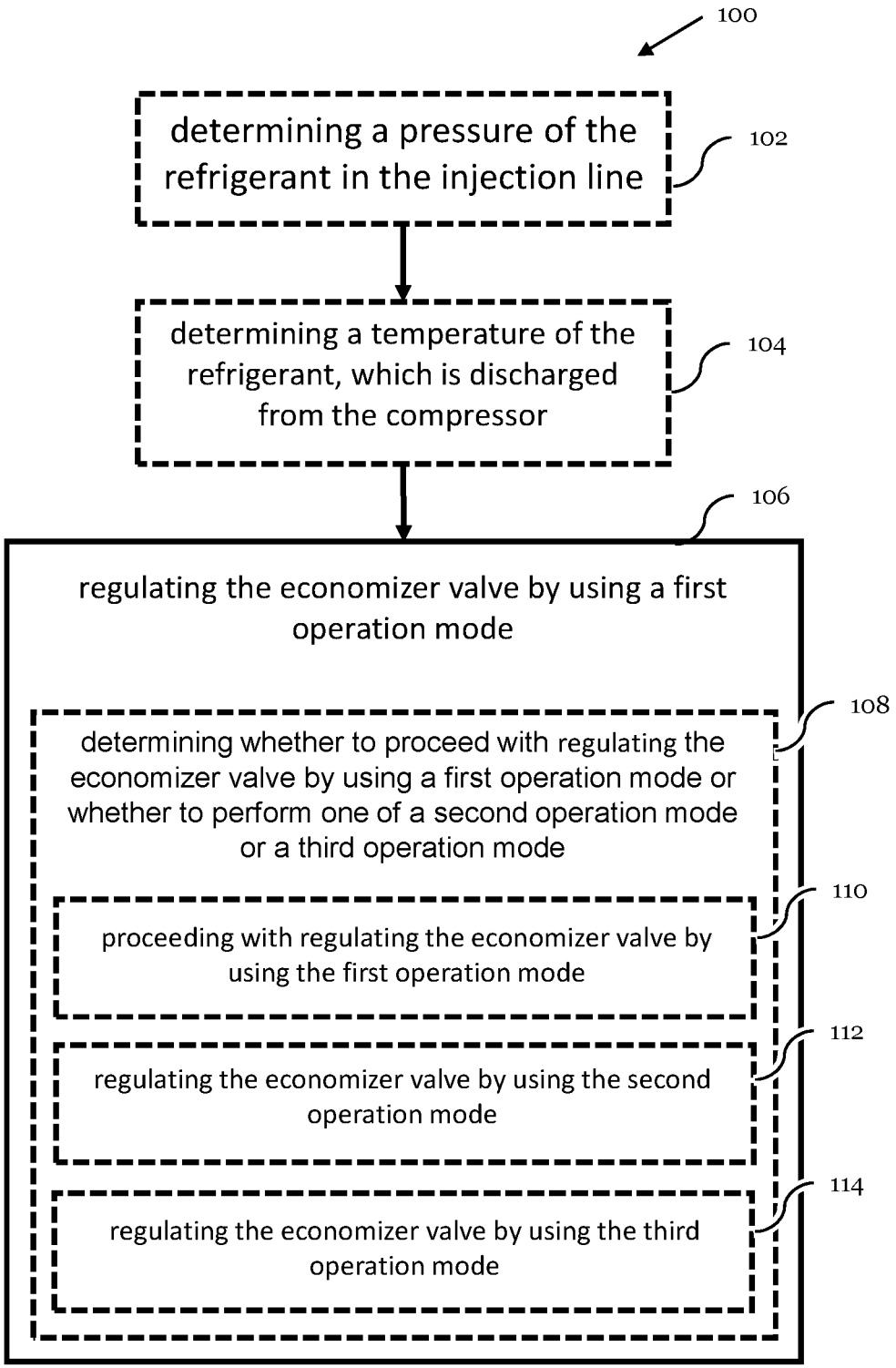
Figure 6:
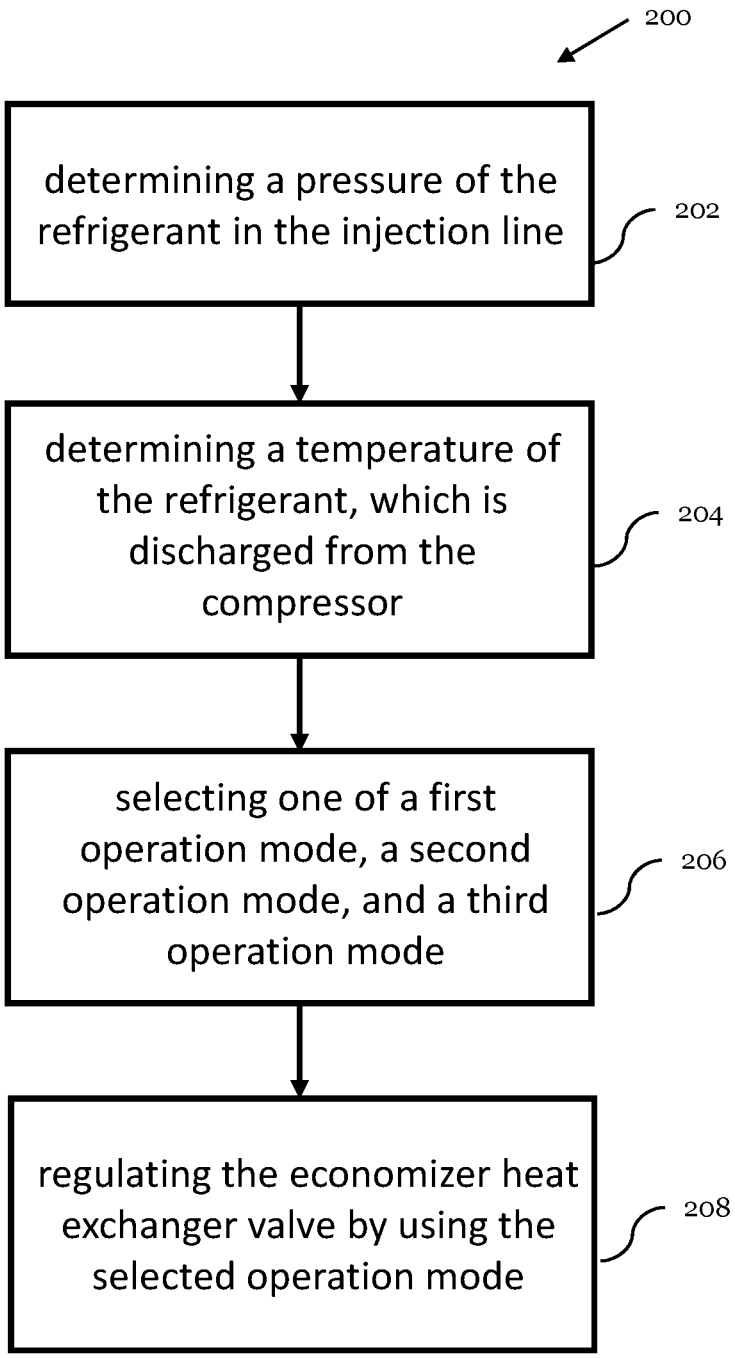
Figure 7:
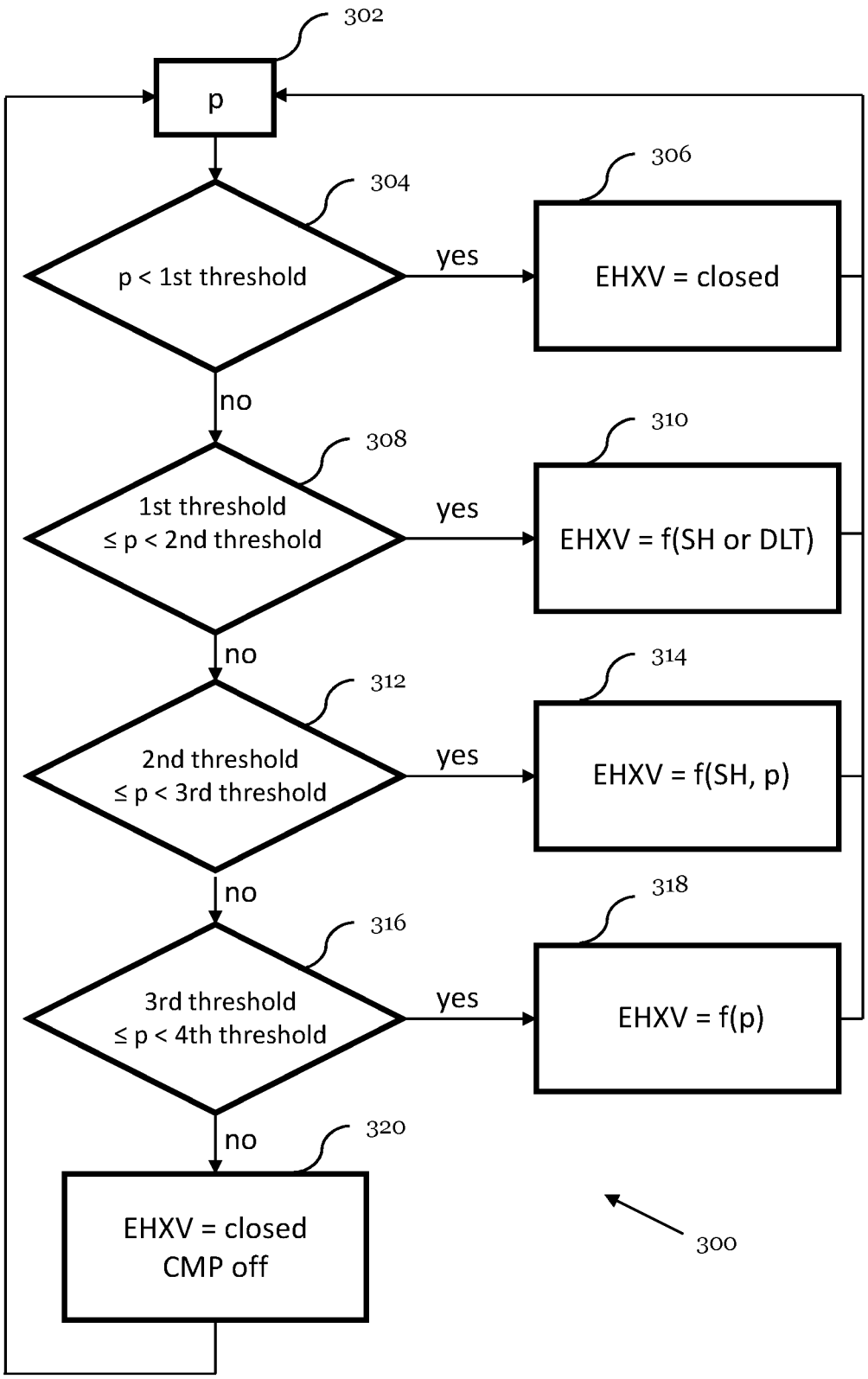
Figure 8:
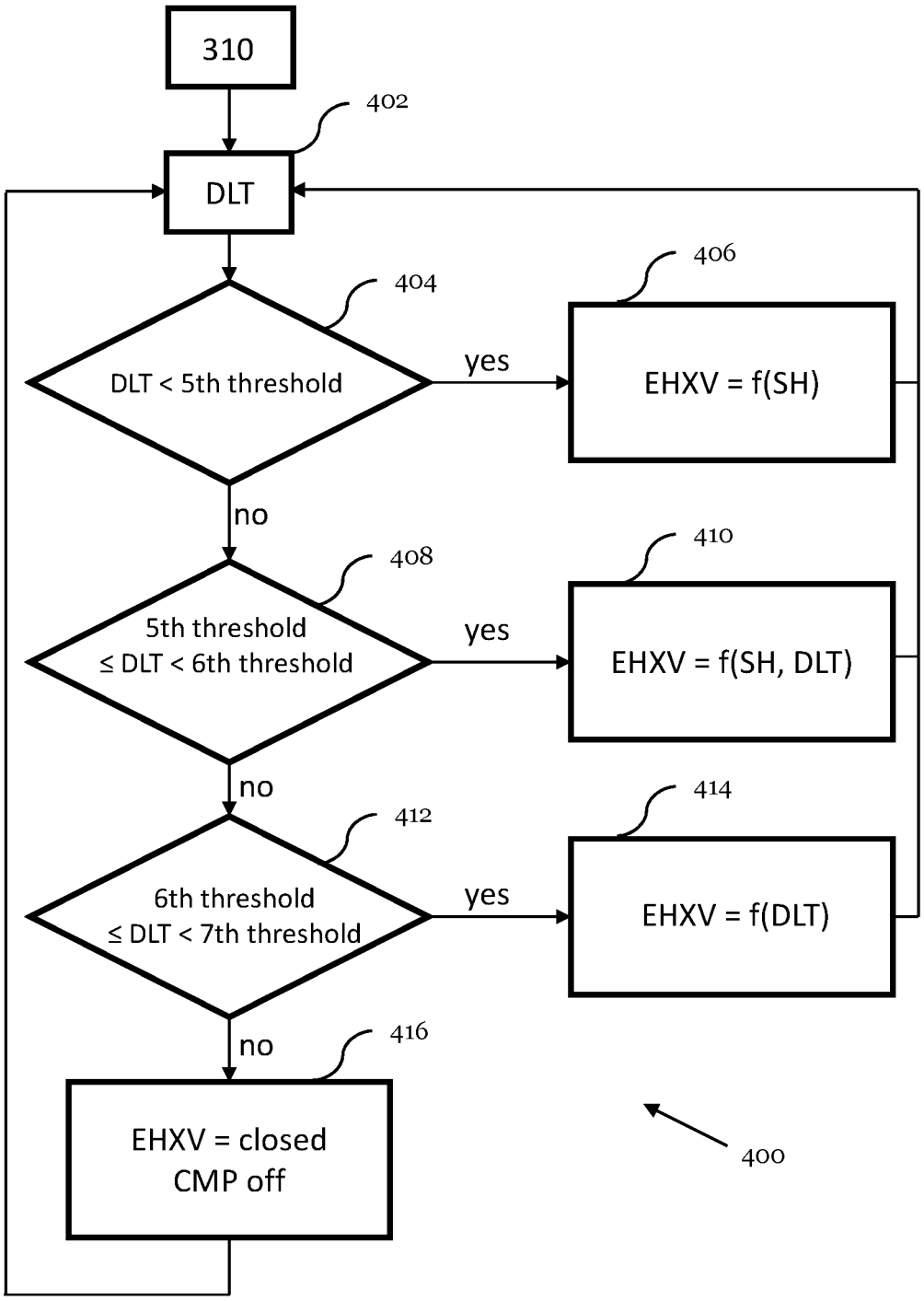
Figure 9:
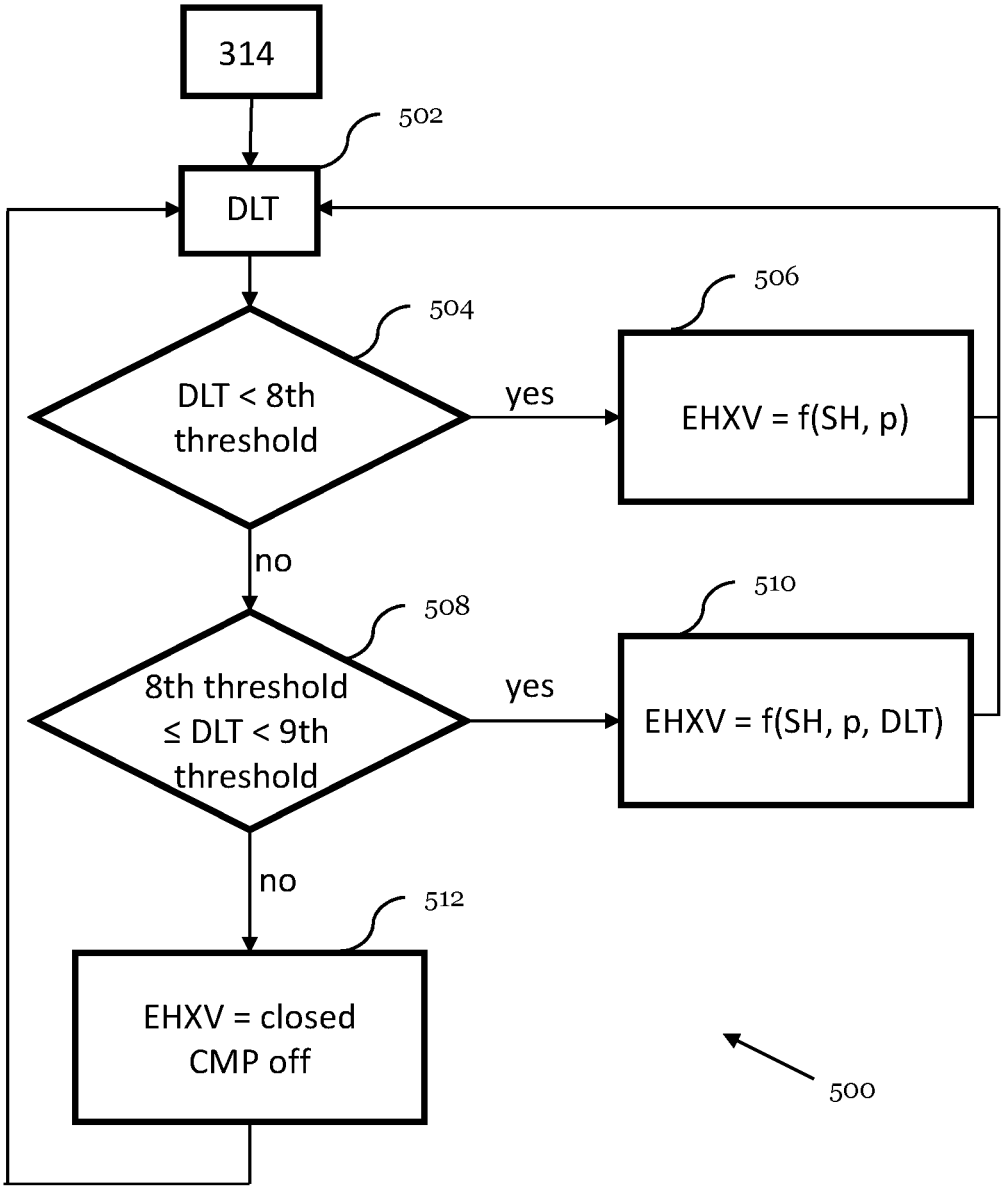
Figure 10:
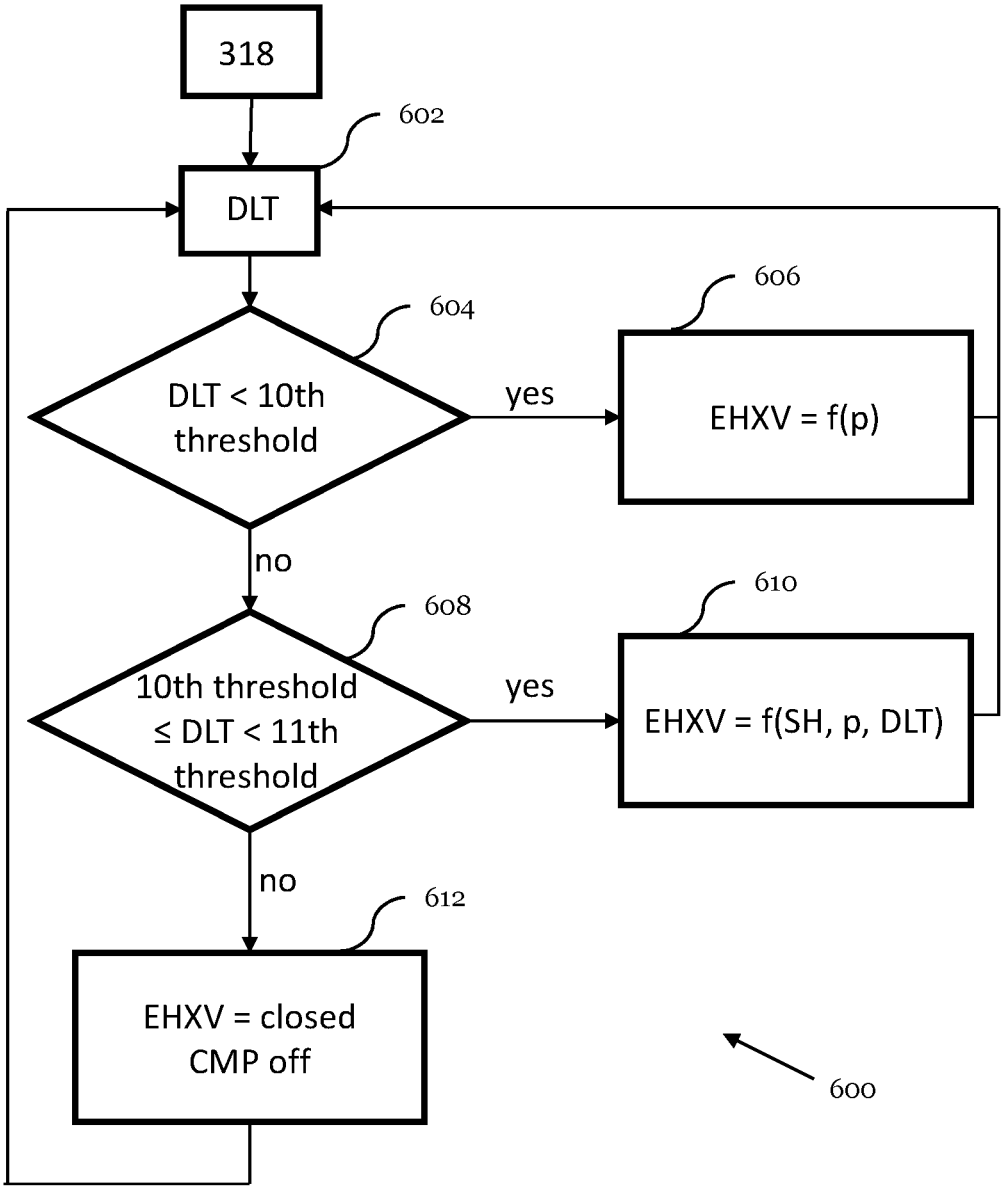

FIG. 4*a*, 4*b* show block diagrams of the inputs and outputs of controllers as may be used in connection with the current invention;

FIG. 5 shows a flow diagram of a method of controlling the injection into a compressor according to an embodiment of the current invention;

FIG. 6 shows a flow diagram of an alternative method of controlling the injection into a compressor according to another embodiment of the current invention;

FIG. 7 shows a decision diagram of a preferred embodiment of a method of controlling the injection into a compressor, wherein the decision diagram relates to regulating the amount of injection into the compressor;

FIG. 8 shows a decision diagram, which further specifies step 310 of FIG. 7;

FIG. 9 shows a decision diagram, which further specifies step 314 of FIG. 7; and FIG. 10 shows a decision diagram, which further specifies step 318 of FIG. 7.

DETAILED DESCRIPTION

The following detailed description refers to the accompanying drawings that show, by way of illustration, specific details and embodiments in which the invention may be practiced.

The word "exemplary" is used herein to mean "serving as an example, instance, or illustration". Any embodiment or design described herein as "exemplary" is not necessarily to be construed as preferred or advantageous over other embodiments or designs.

Figure 1:
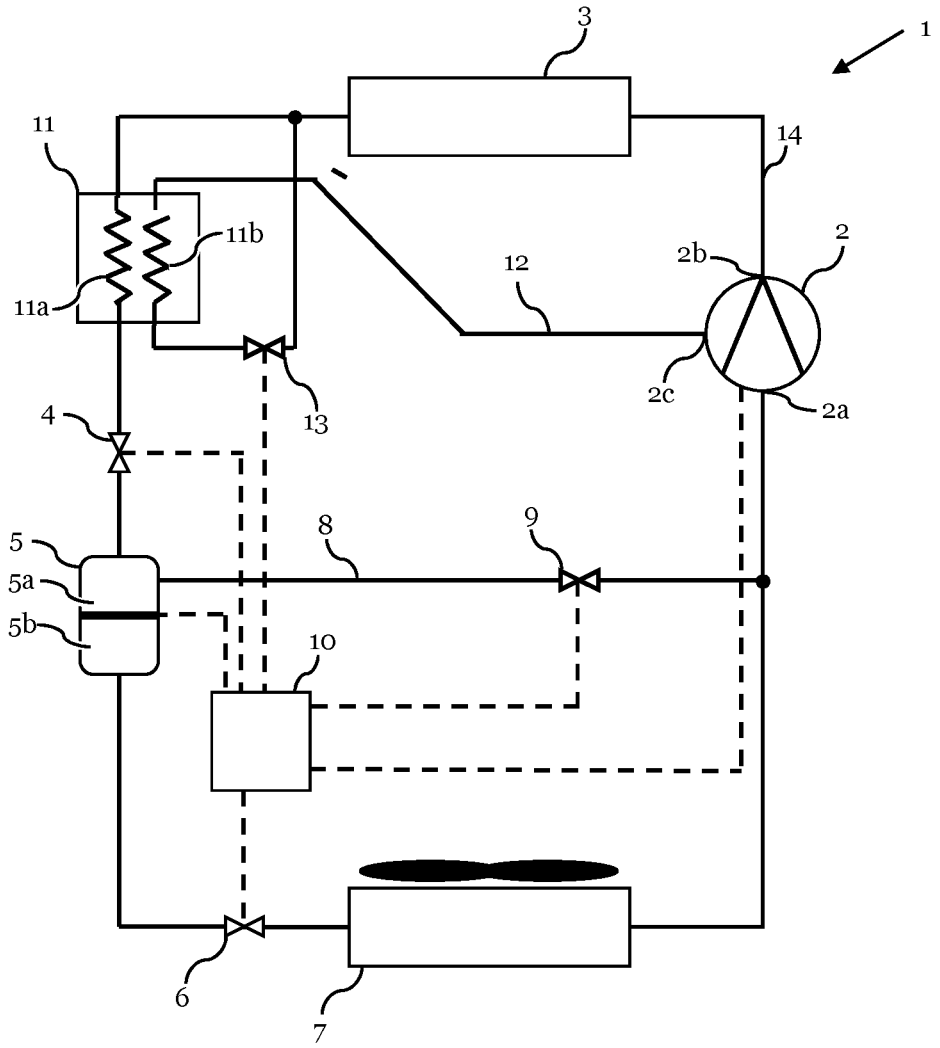
FIG. 1 shows a schematic of an exemplary refrigeration system control of refrigerant injection into a compressor in an economized refrigeration cycle.

FIG. 1 shows a schematic of a refrigeration system 1 for economizer-based control of refrigerant injection into a compressor 2 of the refrigeration system 1. The refrigeration system 1 comprises a compressor 2, which comprises a suction port 2*a*, a discharge port 2*b*, and an injection port 2*c*, a heat rejection heat exchanger 3 downstream of the compressor 2, a first expansion device 4 downstream of the heat rejection heat exchanger 3, and a heat accepting heat exchanger 7 downstream of the first expansion device 4 and upstream of the compressor 2.

Further, the refrigeration system 1 comprises a second expansion device 6 and a flash tank 5. The flash tank 5 and the second expansion device 6 are disposed between the first expansion device 4 and the heat accepting heat exchanger 7. In detail, the flash tank 5 is disposed downstream of the first expansion device 4 and upstream of the second expansion device 6, which is disposed upstream of the heat accepting heat exchanger 7. Thereby, the pressure and the temperature of the refrigerant could be reduced.

In the refrigeration system 1 depicted in FIG. 1, the flash tank 5 comprises two separation chambers 5*a*, 5*b*. However, it would also be possible that the flash tank separates the liquid refrigerant and the vapour refrigerant in the same volume.

The two separation chambers 5*a*, 5*b* include a chamber 5*a* used for collecting vapour or flash gas and a chamber 5*b* for collecting liquid. Liquid collecting chamber 5*b* comprises at least one outlet. The connection between the flash tank 5 and the second expansion device 6 is established via at least one of the at least one outlets of the liquid collecting chamber 5*b* of the flash tank 5.

The vapour collecting chamber 5*a* of the flash tank 5 comprises at least one outlet. The at least one outlet of the vapour collecting chamber 5*a* is connected to the suction port of the compressor 2 via a by-pass path 8 and a by-pass valve 9.

Although a flash tank 5 and a by-pass line 8 are depicted in FIG. 1, the person skilled in the art will appreciate that the flash tank 5 is not necessary for the refrigeration system. In at least some embodiments, no flash tank is used or a flash tank 5 is used without a by-pass line.

The refrigeration system 1 comprises an economizer heat exchanger 11. The economizer heat exchanger comprises two path—a first path 11*a*, which is connected to the heat rejection heat exchanger 3 and the first expansion device 4, and a second path 11*b*, which is connected to the heat rejection heat exchanger 3 via an economizer valve 13 and is connected to the injection port 2*c* of the compressor 2 via an injection line 12. In the example depicted in FIG. 1, the first path and the second path of the economizer have counter-wise flow directions.

In the economizer heat exchanger 11 depicted in FIG. 1, the first path 11*a* and the second path 11*b* are in near proximity to each other, such that heat exchange is possible between both paths. Because the refrigerant in the second path 11*b* is expanded by the economizer valve 13, the refrigerant in the second path 11*b* has a lower temperature than the refrigerant in the first path 11*a*. Therefore, heat is exchanged from the refrigerant of the first path 11*a* to the refrigerant of the second path 11*b*. This process is a sub-cooling process, which decreases the amount of heat of the refrigerant in the first path 11*a* and may thereby also reduce the temperature of the refrigerant in the first path 11*a*.

Further, the refrigeration system 1 comprises a controller 10, which is used for regulating at least the economizer valve 13. Additionally, the controller 10 may also be used to control any of the first expansion device 4, the flash tank 5, the second expansion device 6, the by-pass valve 9, and the compressor 2. The operation of the controller 10 is based on the superheat level of the refrigerant in the economizer heat exchanger 11. Additionally, the controller 10 may also use system parameters like the pressure of the refrigerant in the injection line 12 or the temperature of the refrigerant, which is discharged from the compressor 2.

FIG. 1 indicates the connection for exchanging control signals by ease of dashed lines. Although FIG. 1 shows dashed lines between the controller 10 and the economizer valve 13, the first expansion device 4, the second expansion device 6, the compressor 2, and the flash tank 5, the person skilled in the art will appreciate that these dashed lines are shown for illustration purposes only. The controller 10 may be connected to any subset of the aforementioned components of the refrigeration cycle. With respect to the connection between the controller 10 and the flash tank 5, it is to be noted that the controller 10 may be connected to a sensor within the flash tank 5, wherein the sensor may be a pressure sensor. Furthermore, in some examples, multiple controllers may be employed in the refrigeration system. Each of these multiple controllers may control any subset of the expansion devices, the compressor, and the flash tank as is described before with respect to controller 10.

Figure 2:
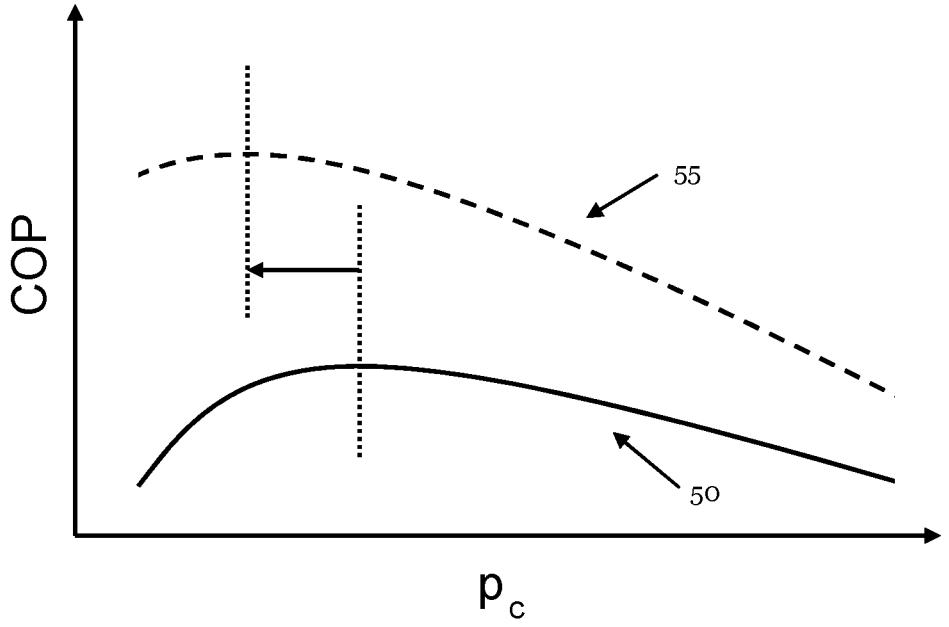
FIG. 2 shows a diagram of the influence of refrigerant injection on the optimum heat rejection heat exchanger pressure.

FIG. 2 shows a diagram of the influence of refrigerant injection on the optimum heat rejection heat exchanger pressure. In detail, FIG. 2 depicts the coefficient of performance (COP) depending on the pressure of the refrigerant in the heat rejection heat exchanger ($p_c$). Thereby, solid line 50 represents the curve of the COP for a refrigeration system with closed injection valve, i.e. without injection of refrigerant into the means for compressing of the compressor.

The dashed line 55 represents an exemplary curve of the COP for the same refrigeration system with an at least partially opened injection valve, i.e. with injection of refrigerant into the means for compressing of the compressor. The difference between the curves is shown for illustrative purpose.

In a refrigeration system, the operating conditions are controlled in order to achieve a higher COP. Without refrigerant injection, the COP depends on the temperature of the refrigerant in the heat rejection heat exchanger. However, refrigerant injection has a direct influence on the efficiency of the system. This influence depends on the injection conditions, like pressure of the injected refrigerant or temperature of the injected refrigerant. As can be seen, injection does not only improve the overall COP. Injection also shifts the maximum of the COP to a lower pressure of the refrigerant in the heat rejection heat exchanger. The maximum of the respective curve represents the optimum heat rejection heat exchanger pressure. This optimum pressure is lower when injection of refrigerant into the compressor is used.

Figure 3:
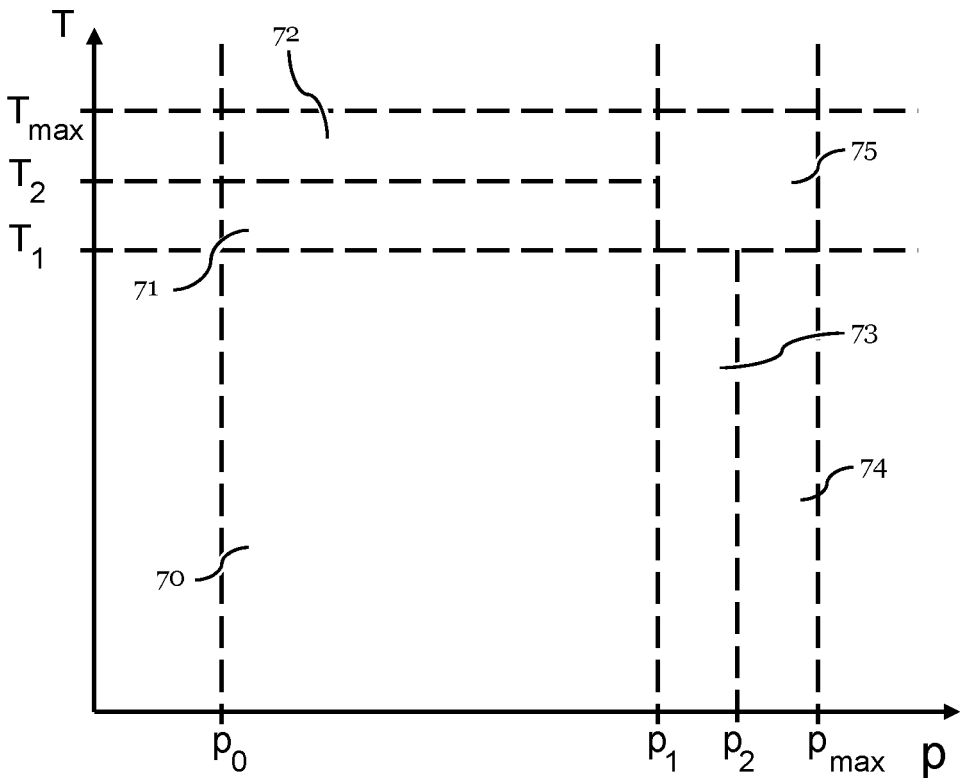
FIG. 3 shows a discharge temperature over injection pressure diagram for exemplary embodiments of the current invention.

FIG. 3 shows a discharge temperature over injection pressure diagram for exemplary embodiments of the current invention. The pressure p corresponds to the pressure at which the refrigerant is injected into the injection port of the compressor. This pressure may be measured in the second path of the economizer or in the injection line and may be referred to as injection pressure. The temperature T corresponds to the temperature of the refrigerant, which is discharged from the discharge port of the compressor. This temperature may be measured at the discharge port or in the connection line between the discharge port and the heat rejection heat exchanger and may be referred to as discharge line temperature, DLT.

In the temperature-pressure-diagram, different areas 70, 71, 72, 73, 74, 75 are depicted. These areas are based on particular pressure and temperature thresholds and indicate the pressure and temperature ranges for each of the three operation modes or combinations thereof.

Below an injection pressure of $p_0$, no injection into the compressor is performed. In this case, the injection pressure would be too low for an efficient injection. Instead, the pressure may be so low that the refrigerant from the injection line would not be injected into the compressor, but that undesired reverse flow from the compressor through the discharge line may occur. $P_0$ may be referred to as minimum pressure for injection.

Also, there will be no injection performed for a pressure higher than $p_{max}$. If the pressure would exceed $p_{max}$, the refrigerant would be injected at such a high pressure that the compressor may be damaged or the efficiency of the refrigeration cycle would be reduced. Similarly, no injection will be performed for temperatures exceeding a maximum temperature value of $T_{max}$.

Between the pressure stages $p_0$ and $p_{max}$, injection is performed based on the three operation modes or combinations thereof. Thereby, the first operation mode is denoted as superheat control mode. The first operation mode is performed for pressure ranges from $p_0$ up to $p_1$ and temperature ranges below $T_1$. The corresponding area in the temperature-pressure-diagram is area 70.

The second operation mode is denoted as discharge line temperature control mode and is performed for pressure ranges from $p_0$ up to $p_1$ and temperature ranges between $T_2$ and $T_{max}$. The corresponding area in the temperature-pressure-diagram is area 72.

At 71, for $p_0$ to $p_1$ and $T_1$ to $T_2$, a combination of the superheat control mode and the discharge line temperature control mode is performed.

The third operation mode is denoted as injection pressure control mode and is performed for pressure ranges from $p_2$ up to $p_{max}$ and temperature ranges below $T_1$. The corresponding area in the temperature-pressure-diagram is area 74.

At 73, for $p_1$ to $p_2$ and discharge line temperatures below $T_1$, a combination of the superheat control mode and injection pressure control mode is performed.

Further, for discharge line temperatures higher than $T_1$ and injection pressures between $p_1$ and $p_{max}$, a combination of all three operation modes is performed in area 75.

The person skilled in the art will appreciate that the pressure stages $p_1$ and the temperature stages $T_i$ are for illustrative purposes. The particular values of these stages depend on the system to which the control operation is applied.

FIGS. 4*a*, 4*b* show block diagrams of the inputs and the outputs of controllers as may be used in connection with the current invention.

In FIG. 4*a*, the controller, which is represented by block "CTRL" receives the superheat value of the refrigerant in the second path of the economizer as input and controls at least the economizer valve, which is denoted as economizer heat exchanger valve "EHXV". Additionally, the controller may also control the operation of the compressor CMP. In FIG. 4*a*, the output arrow of the compressor CMP is shown as dashed line in order to illustrate that the controller may perform economizer valve control, or both, the economizer valve control and the compressor control.

In FIG. 4*b*, the controller receives the superheat value as input and controls the economizer valve and optionally the compressor. Further, the controller receives the pressure of the refrigerant in the injection line (denoted as economizer heat exchanger pressure "EHXP") and the temperature of the refrigerant in the discharge line (denoted as discharge line temperature "DLT") as additional inputs.

FIG. 5 shows a flow diagram of a method 100 of controlling the injection into a compressor according to an embodiment of the invention. The method 100 may be performed by a controller in a refrigeration cycle, for example controller 10 as depicted in FIG. 1. Throughout the flow diagram, solid lines indicate steps, which are essential to the current invention, whereas dashed lines indicate steps, which are performed in preferred embodiments of the current invention.

The method 100 comprises the step of determining 102 a pressure of the refrigerant in the injection line 12. Determining a pressure of the refrigerant in the injection line may comprise determining a pressure in any part of the injection line 12, the second path of the economizer heat exchanger 11*b*, or at the outlet of the second path of the economizer heat exchanger 11*b*.

Further, the method 100 comprises the step of determining 104 a temperature of the refrigerant in the discharge line 14. Because of the similar temperature of the refrigerant at the discharge port 2*b* and the discharge line 14, determining the temperature of the refrigerant at the discharge port 2*b* of the compressor 2 also may be performed by measuring the temperature of the refrigerant in the discharge line 14.

Also, the method comprises regulating 106 the economizer valve 13 by using a first operation mode. The first operation mode may correspond to the superheat control mode. Regulating 106 the economizer valve 13 may comprise determining 108 whether to proceed with regulating the economizer valve by using the first operation mode or whether to perform one of a second and a third operation mode. Thereby, the first operation mode may establish a default operation of the controller. The second operation mode may correspond to the discharge line temperature control mode and the third operation mode may correspond to the injection pressure control mode.

Based on the determining 108, the method 100 may comprise proceeding 110 with regulating 106 the economizer valve by using the first operation mode, or regulating 112 the economizer valve by using the second operation mode, or regulating 114 the economizer valve by using the third operation mode.

FIG. 6 shows a flow diagram of the method 200 of controlling the injection into a compressor according to an alternative embodiment of the invention. The method 200 may be performed by a controller in a refrigeration cycle, for example controller 10 as depicted in FIG. 1.

The method 200 comprises the step of determining 202 a pressure of the refrigerant in the injection line 12. Determining a pressure of the refrigerant in the injection line may comprise determining a pressure in any part of the injection line 12, the second path of the economizer heat exchanger 11*b*, or at the outlet of the second path of the economizer heat exchanger 11*b*.

Further, the method 200 comprises the step of determining 204 a temperature of the refrigerant in the discharge line 14. Because of the similar temperature of the refrigerant at the discharge port 2*b* and in the discharge line 14, determining the temperature of the refrigerant at the discharge port of the compressor 2 also may be performed by measuring the temperature of the refrigerant in the discharge line 14.

Also, the method 200 comprises the step of selecting 206 one of a first operation mode, a second operation mode, and a third operation mode. Thereby, the first operation mode may correspond to the superheat control mode, the second operation mode may correspond to the discharge line temperature control mode, and the third operation mode may correspond to the injection pressure control mode.

Further, the method 200 comprises regulating 208 the economizer valve 13 by using the selected operation mode.

FIG. 7 shows a decision diagram 300 of a preferred embodiment of a method of controlling the injection into a compressor, wherein the decision diagram relates to regulating the amount of injection into the compressor. The amount of injection into the compressor is controlled by regulating the so-called economizer valve or economizer heat exchanger valve, which is referred to as EHXV (cf. reference sign 13 in FIG. 1). The decision may be carried out by a controller, for example controller 10.

The method starts at step 302 where the determined pressure of the refrigerant in the injection line is received. In FIG. 7, the pressure of the refrigerant in the injection line is referred to as p.

At step 304, it is determined whether the injection pressure p is below a first threshold. In case that the pressure is lower than the first threshold, the method continues at step 306 where the economizer valve EHXV is closed. Otherwise, the method continues at step 308.

At step 308, it is determined whether the injection pressure p is greater than or equal to the first threshold and lower than a second threshold. In case that the injection pressure is greater than or equal to the first threshold and lower than the second threshold, the method continues at step 310 where the economizer valve EHXV is opened. There, the opening degree of the economizer valve EHXV is calculated as a function of at least one of the superheat value, SH, of the refrigerant in the economizer heat exchanger or the temperature of the refrigerant in the discharge line, DLT. As will be described in more detail with respect to FIG. 8, the opening degree may be calculated based on the superheat value, the discharge line temperature, or a combination of both, depending on value of the discharge line temperature. In case that the injection pressure is not greater than or equal to the first threshold and lower than the second threshold, the method continues at step 312.

At step 312, it is determined whether the injection pressure p is greater than or equal to the second threshold and lower than a third threshold. In case that the injection pressure is greater than or equal to the second threshold and lower than the third threshold, the method continues at step 314 where the economizer valve EHXV is opened. There, the opening degree of the economizer valve EHXV is calculated as a function of at least the superheat value, SH, the injection pressure, p. As will be described in more detail with respect to FIG. 9, the opening degree may be calculated based on the injection pressure, the discharge line temperature, or a combination of both, depending on value of the discharge line temperature. Additionally, considering the superheat value for the calculation may also be possible. In case that the injection pressure is not greater than or equal to the second threshold and lower than the third threshold, the method continues at step 316.

At step 316, it is determined whether the injection pressure p is greater than or equal to the third threshold and lower than a fourth threshold. In case that the injection pressure is greater than or equal to the third threshold and lower than the fourth threshold, the method continues at step 318 where the economizer valve EHXV is opened. There, the opening degree of the economizer valve EHXV is calculated as a function of at least the injection pressure, p. As will be described in more detail with respect to FIG. 10, the discharge line temperature or the superheat value may also be considered for the calculation of the opening degree, depending on value of the discharge line temperature. In case that the injection pressure is not greater than or equal to the third threshold and lower than the fourth threshold, the method continues at step 320 where the economizer valve EHXV is closed and the compressor is turned off.

In case the method reaches either one of steps 306, 310, 314, 318, or 320, the method may again continue at step 302 by determining or receiving an injection pressure p. In this case, the method may determine or receive an updated value for the injection pressure p.

FIG. 8 shows a decision diagram, which describes a method 400 for determining the opening degree of the economizer valve EHXV based on step 310 of the decision diagram of FIG. 7 in more detail.

Following step 310, method 400 receives a determined value for the temperature of the refrigerant in the discharge line at step 402.

At step 404, it is determined whether the discharge line temperature DLT is below a fifth threshold. In case that the temperature is lower than the fifth threshold, the method continues at step 406 where the opening degree of the economizer valve EHXV is calculated as a function of the superheat level of the refrigerant in the economizer. This refers to the first operation mode, also called superheat control mode. With reference to FIG. 3, step 406 may refer to the operation performed for pressure and temperature being located in area 70. Otherwise, the method continues at step 408.

At step 408, it is determined whether the discharge line temperature DLT is greater than or equal to the fifth threshold and lower than a sixth threshold. In case that the temperature is greater than or equal to the fifth threshold and lower than the sixth threshold, the method continues at step 410 where the opening degree of the economizer valve is calculated as a function of the superheat level of the refrigerant in the economizer and the temperature of the refrigerant in the discharge line, DLT. Thereby, a combination of the superheat control and the discharge line control mode may be performed. With reference to FIG. 3, step 410 may refer to the operation performed for pressure and temperature being located in area 71. In case that the discharge line temperature is not greater than or equal to the fifth threshold and lower than the sixth threshold, the method continues at step 412.

At step 412, it is determined whether the discharge line temperature DLT is greater than or equal to the sixth threshold and lower than a seventh threshold. In case that the temperature is greater than or equal to the sixth threshold and lower than the seventh threshold, the method continues at step 414 where the opening degree of the economizer valve EHXV is calculated as a function of the temperature of the refrigerant in the discharge line, DLT. Thereby, the operation is performed based on the discharge line control mode. With reference to FIG. 3, step 414 may refer to the operation performed for pressure and temperature being located in area 72. In case that the discharge line temperature is not greater than or equal to the sixth threshold and lower than seventh threshold, the method continues at step 416 where the economizer valve EHXV is closed and the compressor is turned off.

In case the method reaches either one of steps 406, 410, 414, or 416, the method may again continue at step 402 by determining or receiving the discharge line temperature. In this case, the method may determine or receive an updated value for the discharge line temperature.

FIG. 9 shows a decision diagram, which describes a method 500 for determining the opening degree of the economizer valve EHXV based on step 314 of the decision diagram of FIG. 7 in more detail.

Following step 314, method 500 receives a determined value for the temperature of the refrigerant in the discharge line at step 502.

At step 504, it is determined whether the discharge line temperature DLT is below an eighth threshold. In case that the temperature is lower than the eighth threshold, the method continues at step 506 where the opening degree of the economizer valve EHXV is calculated as a function of the pressure of the refrigerant in the injection line and the superheat value. Thereby, a combination of the superheat control mode and the injection pressure control mode is performed. With reference to FIG. 3, step 506 may refer to the operation performed for pressure and temperature being located in area 73. Otherwise, the method continues at step 508.

At step 508, it is determined whether the discharge line temperature DLT is greater than or equal to the eighth threshold and lower than a ninth threshold. In case that the temperature is greater than or equal to the eighth threshold and lower than the ninth threshold, the method continues at step 510 where the opening degree of the economizer valve is calculated as a function of the superheat value, the pressure of the refrigerant in the injection line, and the temperature of the refrigerant in the discharge line, DLT. Thereby, a combination of all three operation modes is performed. With reference to FIG. 3, step 510 may refer to the operation performed for pressure and temperature being located in area 75. In case that the discharge line temperature is not greater than or equal to the eighth threshold and lower than the ninth threshold, the method continues at step 512, where the economizer valve EHXV is closed and the compressor is turned off.

In some embodiments, the eighth threshold is equal to the fifth threshold and the ninth threshold is equal to the seventh threshold.

In case the method reaches either one of steps 506, 510, or 512, the method may again continue at step 502 by determining or receiving the discharge line temperature. In this case, the method may determine or receive an updated value for the discharge line temperature.

FIG. 10 shows a decision diagram, which describes a method 600 for determining the opening degree of the economizer valve EHXV based on step 318 of the decision diagram of FIG. 7 in more detail.

Following step 318, method 600 receives a determined value for the temperature of the refrigerant in the discharge line at step 602.

At step 604, it is determined whether the discharge line temperature DLT is below a tenth threshold. In case that the temperature is lower than the tenth threshold, the method continues at step 606 where the opening degree of the economizer valve EHXV is calculated as a function of the pressure of the refrigerant in the injection line. Thereby, injection pressure control mode is performed. With reference to FIG. 3, step 606 may refer to the operation performed for pressure and temperature being located in area 74. Otherwise, the method continues at step 608.

At step 608, it is determined whether the discharge line temperature DLT is greater than or equal to the tenth threshold and lower than an eleventh threshold. In case that the temperature is greater than or equal to the tenth threshold and lower than the eleventh threshold, the method continues at step 610 where the opening degree of the economizer valve is calculated as a function of the superheat value, the pressure of the refrigerant in the injection line, and the temperature of the refrigerant in the discharge line, DLT. Thereby, a combination of all three operation modes is performed. With reference to FIG. 3, step 610 may refer to the operation performed for pressure and temperature being located in area 75. In case that the discharge line temperature is not greater than or equal to the tenth threshold and lower than the eleventh threshold, the method continues at step 612, where the economizer valve EHXV is closed and the compressor is turned off.

In some embodiments, the tenth threshold is equal to the fifth threshold and the eleventh threshold is equal to the seventh threshold.

In case the method reaches either one of steps 606, 610, or 612, the method may again continue at step 602 by determining or receiving the discharge line temperature. In this case, the method may determine or receive an updated value for the discharge line temperature.

In some embodiments, the operation of the control operation is performed on the basis of the interrelated methods described with respect to FIGS. 7 to 10. If, in such a case, the eighth threshold is equal to the fifth threshold and the ninth threshold is equal to the seventh threshold and the tenth threshold is equal to the fifth threshold and the eleventh threshold is equal to the seventh threshold, one arrives at the areas 70 to 75 described with respect to FIG. 2, wherein the first threshold corresponds to $p_0$, the second threshold corresponds to $p_1$, the third threshold corresponds to $p_2$, the fourth threshold corresponds to $p_{max}$, the fifth threshold corresponds to $T_1$, the sixth threshold corresponds to $T_2$, and the seventh threshold corresponds to $T_{max}$. Accordingly, the first operation mode, which is the superheat control mode, is performed in area 70, the second operation mode, which is the discharge line temperature control mode, is performed in area 72, and the third operation mode, which is the injection pressure control mode, is performed in area 74, whereas a combination of the first and second control modes is performed in area 71, a combination of the first and the third operation modes is performed in area 73, and a combination of all three operation modes is performed in area 75, and the economizer expansion valve is closed, while the compressor is turned off outside of areas 70 to 75.

What has been described above includes examples of one or more embodiments. It is, of course, not possible to describe every conceivable combination of components or methodologies for purposes of describing the aforementioned embodiments, but one of ordinary skill in the art may recognize that many further combinations and permutations of various embodiments are possible. Accordingly, the described embodiments are intended to embrace all such alterations, modifications and variations that fall within the scope of the appended claims.

What is claimed is:

1. A method of controlling injection into a compressor in a refrigeration cycle, wherein the method is performed in a refrigeration cycle, which comprises at least an economizer heat exchanger, a heat rejection heat exchanger, a first expansion device, and a compressor configured for compressing the refrigerant, wherein the compressor comprises a means for compressing, a suction port, a discharge port, and an injection port, wherein the discharge port is connected to the heat rejection heat exchanger via a discharge line and wherein the injection port is connected to the means for compressing, and wherein the economizer heat exchanger comprises:

a first path, which has an input, which is connected to the heat rejection heat exchanger, and an output, which is connected to the first expansion device, and a second path, which has an input, which is connected to the heat rejection heat exchanger via an economizer valve, and an output, which is connected to the injection port of the compressor via an injection line;

the method comprising:

regulating the economizer valve by using a first operation mode, which is based on a superheat level of the refrigerant in the economizer heat exchanger, determining a pressure of the refrigerant in the injection line;

determining a temperature of the refrigerant in the discharge line; and wherein the regulating comprises:

based on the determined pressure and the determined temperature, determining whether to proceed with regulating the economizer valve based on the superheat level of the refrigerant at the output of the economizer heat exchanger or whether to perform one of:

regulating the economizer valve by using a second operation mode based at least on the temperature of the refrigerant in the discharge line, or regulating the economizer valve by using a third operation mode based at least on the pressure of the refrigerant in the injection line.

2. The method according to claim 1, wherein:

the heat rejection heat exchanger is disposed downstream of the discharge port of the compressor;

the first expansion device is disposed downstream of the heat rejection heat exchanger and upstream of the suction port of the compressor.

3. The method according to claim 1, wherein the first operation mode comprises setting an opening degree of the economizer valve to a value calculated by using the first operation mode in order to keep the superheat level of the refrigerant at the output of the second path of the economizer heat exchanger in a predetermined range.

4. The method according to claim 1, wherein the regulating comprises:

based on the determined pressure and the determined temperature, determining whether to perform regulating the economizer valve by using any combination of the first operation mode, the second operation mode, and the third operation mode.

5. The method according to claim 1, wherein regulating the economizer valve by using the second operation mode comprises regulating the economizer valve in order to keep the temperature of the refrigerant in the discharge line below a first predetermined setpoint.

6. The method according to claim 1, wherein regulating the economizer valve by using the third operation mode comprises regulating the economizer valve in order to keep the pressure of the refrigerant in the injection line below a second predetermined setpoint.

7. The method according to claim 1, wherein the regulating further comprises:

if the determined pressure of the refrigerant in the injection line is determined to be below a first threshold, closing the economizer valve;

if the determined pressure of the refrigerant in the injection line is determined to be above the first threshold and below a second threshold, setting the opening degree of the economizer valve to a value calculated by using at least one of the first operation mode or the second operation mode;

if the determined pressure of the refrigerant in the injection line is determined to be above the second threshold and below a third threshold, setting the opening degree of the economizer valve to a value calculated by using a combination of at least the first operation mode and the third operation mode;

if the determined pressure of the refrigerant in the injection line is determined to be above the third threshold and below a fourth threshold, setting the opening degree of the economizer valve to a value calculated by using at least the third operation mode;

if the determined pressure of the refrigerant in the injection line is determined to be above the fourth threshold, closing the economizer valve and stopping operation of the compressor.

8. The method according to claim 7, wherein setting the opening degree of the economizer valve to a value calculated by using at least the first operation mode or the second operation mode comprises:

if the determined temperature of the refrigerant in the discharge line is below a fifth threshold, setting the opening degree of the economizer valve to a value calculated by using the first operation mode, which comprises setting an opening degree of the economizer valve to a value calculated from the superheat level of the refrigerant in the second path of the economizer heat exchanger;

if the determined temperature of the refrigerant in the discharge line is above the fifth threshold and below a sixth threshold, setting the opening degree of the economizer valve to a value calculated from the superheat level of the refrigerant in the economizer heat exchanger and the determined temperature of the refrigerant in the discharge line;

if the determined temperature of the refrigerant in the discharge line is above the sixth threshold and below a seventh threshold, setting the opening degree of the economizer valve to a value calculated from the determined temperature of the refrigerant in the discharge line; and if the determined temperature of the refrigerant in the discharge line is above the seventh threshold, closing the economizer valve and stopping operation of the compressor.

9. The method according to claim 7, wherein setting the opening degree of the economizer valve to a value calculated by using a combination of at least the first operation mode and the third operation mode comprises:

if the determined temperature of the refrigerant in the discharge line is below an eighth threshold, setting the opening degree of the economizer valve to a value calculated from the determined pressure of the refrigerant in the injection line and the superheat value;

if the determined temperature of the refrigerant in the discharge line is above the eighth threshold and below a ninth threshold, setting the opening degree of the economizer valve to a value calculated from the determined pressure of the refrigerant in the injection line, the determined temperature of the refrigerant in the discharge line and the superheat value; and if the determined temperature of the refrigerant in the discharge line is above the ninth threshold, closing the economizer valve and stopping operation of the compressor.

10. The method according to claim 9, wherein the eighth threshold is equal to the fifth threshold and wherein the ninth threshold is equal to the seventh threshold.

11. The method according to claim 7, wherein setting the opening degree of the economizer valve to a value calculated by using at least the third operation mode comprises:

if the determined temperature of the refrigerant in the discharge line is below a tenth threshold, setting the opening degree of the economizer valve to a value calculated from the determined pressure of the refrigerant at economizer heat exchanger;

if the determined temperature of the refrigerant in the discharge line is above the tenth threshold and below an eleventh threshold, setting the opening degree of the economizer valve to a value calculated from the determined pressure of the refrigerant at economizer heat exchanger, the determined temperature of the refrigerant in the discharge line, and the superheat value; and if the determined temperature of the refrigerant in the discharge line is above the eleventh threshold, closing the economizer valve and stopping operation of the compressor.

12. The method of claim 11, wherein the tenth threshold is equal to the fifth threshold and wherein the eleventh threshold is equal to the seventh threshold.

13. A method of controlling injection into a compressor in a refrigeration cycle, wherein the method is performed in a refrigeration cycle, which comprises at least an economizer heat exchanger, a heat rejection heat exchanger, a first expansion device, and a compressor configured for compressing the refrigerant, wherein the compressor comprises a means for compressing, a suction port, a discharge port, and an injection port, wherein the discharge port is connected to the heat rejection heat exchanger via a discharge line and wherein the injection port is connected to the means for compressing, and wherein the economizer heat exchanger comprises:

a first path, which has an input, which is connected to the heat rejection heat exchanger, and an output, which is connected to the first expansion device, and a second path, which has an input, which is connected to the heat rejection heat exchanger via an economizer valve, and an output, which is connected to the injection port of the compressor via an injection line;

the method comprising:

determining a pressure of the refrigerant in the injection line;

determining a temperature of the refrigerant in the discharge line; and based on the determined pressure and the determined temperature, selecting one of:

a first operation mode for regulating the economizer valve based on a superheat level of the refrigerant at the output of the second path of the economizer heat exchanger, a second operation mode for regulating the economizer valve based on the temperature of the refrigerant in the discharge line, and a third operation mode for regulating the economizer valve based on the pressure of the refrigerant in the injection line;

regulating the economizer valve by using the selected operation mode.

* * * * *